US008321230B2

(12) United States Patent
Philippe et al.

(10) Patent No.: US 8,321,230 B2
(45) Date of Patent: Nov. 27, 2012

(54) METHOD AND DEVICE FOR THE HIERARCHICAL CODING OF A SOURCE AUDIO SIGNAL AND CORRESPONDING DECODING METHOD AND DEVICE, PROGRAMS AND SIGNALS

(75) Inventors: Pierrick Philippe, Melesse (FR); Patrice Collen, Montgermont (FR); Christophe Veaux, Paris (FR)

(73) Assignee: France Telecom, Paris (FR)

( * ) Notice: Subject to any disclaimer, the term of this patent is extended or adjusted under 35 U.S.C. 154(b) by 1058 days.

(21) Appl. No.: 12/278,547

(22) PCT Filed: Feb. 5, 2007

(86) PCT No.: PCT/FR2007/050751

§ 371 (c)(1),
(2), (4) Date: Aug. 6, 2008

(87) PCT Pub. No.: WO2007/090988

PCT Pub. Date: Aug. 16, 2007

(65) Prior Publication Data

US 2009/0171672 A1 Jul. 2, 2009

(30) Foreign Application Priority Data

Feb. 6, 2006 (FR) ..... 06 01067

(51) Int. Cl.
*G10L 19/00* (2006.01)

(52) U.S. Cl. ..... 704/500; 704/200; 704/229; 704/503; 709/231

(58) Field of Classification Search ..... 704/500, 704/200, 229, 503; 709/231
See application file for complete search history.

(56) References Cited

U.S. PATENT DOCUMENTS

| | | | | |
|---|---|---|---|---|
| 6,446,037 | B1 * | 9/2002 | Fielder et al. | 704/229 |
| 7,996,233 | B2 * | 8/2011 | Oshikiri | 704/500 |
| 2006/0023748 | A1 * | 2/2006 | Chandhok et al. | 370/469 |

FOREIGN PATENT DOCUMENTS

| | | |
|---|---|---|
| EP | 1 533 789 | 5/2005 |
| WO | WO 2005/001813 | 1/2005 |

* cited by examiner

*Primary Examiner* — Vincent P Harper
(74) *Attorney, Agent, or Firm* — Cozen O'Connor

(57) ABSTRACT

Hierarchical coding of a source audio signal in the form of a data stream including a base level and at least two hierarchical enhancement levels, each of the levels being organized in successive frames. At least one frame of at least one enhancement level has a duration less than the duration of at least one frame of the base level. At least one indication representative of an order used for a set of enhancement level frames corresponding to the duration of at least one frame of the base level is inserted into the data stream.

15 Claims, 5 Drawing Sheets

METHOD AND DEVICE FOR THE HIERARCHICAL CODING OF A SOURCE AUDIO SIGNAL AND CORRESPONDING DECODING METHOD AND DEVICE, PROGRAMS AND SIGNALS

RELATED APPLICATIONS

This is a U.S. national stage under 35 USC 371 of application No. PCT/FR2007/050751, filed on Feb. 5, 2007.

This application claims the priority of French patent application no. 06/01067 filed Feb. 6, 2006, the content of which is hereby incorporated by reference.

FIELD OF THE INVENTION

The field of the invention is that of the compression and transmission of digital audio signals and, more specifically, the coding and decoding of digital audio signals.

The invention applies more particularly to the coding and decoding of digital audio signals in a scalable way, said signals being able to be formatted as bit streams presenting a hierarchical structure in layers, or in levels.

The invention in particular proposes the formatting of a bit stream, composed of frames, or access units, belonging to different layers, in the context of a digital audio signal coding/decoding system.

BACKGROUND OF THE INVENTION

The hierarchical coding/decoding systems hierarchically organize the information to be transmitted or decoded from a digital signal in the form of a bit stream. Thus, according to the instantaneous bandwidth of the transmission channel or the processing capacity of the terminal reading the bit stream, all the stream, or only a part of the stream, is transmitted or decoded while ensuring that, in all cases, the essential information is transmitted and decoded.

These hierarchical systems also provide a differentiated channel protection of the data leading to a more robust transmission.

The current hierarchical audio coding techniques operate in frame-by-frame mode and the generated bit streams comprise access units describing the signal portions as indicated in the reference document relating to the "MPEG-4 audio" standard referenced ISO IEC SC29 WG11 International standard 14496-3:2001.

FIG. 1 shows a diagram of a bit stream 10 formatted from frames belonging to three levels 111, 112, 113 of a conventional hierarchical coding. The frames are therefore organized into a base layer 111 and two or more enhancement or enrichment layers 112 and 113 comprising frames 101 to 109 of the same duration.

For the construction of such a bit stream 10, only one strategy is conventionally considered. As illustrated by FIG. 1, the frames of the coded bit stream 10 are read according to the time axis t, then from the lowest level to the highest enhancement level (according to the axis Q), that is from the frame 101 to the frame 109.

The orders of priority of the frames are implicit.

The units are assigned a time stamp "cts" (standing for "Composition Time Stamp"). The two stamps correspond to the clock times by which the packets must be restored after decoding by the reading terminal.

Each unit with the same cts can be truncated (typically by a sending or routing device), the quality reconstructed on the decoder then being proportional to the number of layers received.

This conventional hierarchical coding/decoding technique considers only the transmission of entities for which the sending priority imposes a single hierarchy: either the units are of equal durations, or the base hierarchical level has a shorter duration than the other levels (example: enhancement of a CELP layer by a scalable AAC layer as stated in the reference document concerning the abovementioned "MPEG-4 audio" standard).

SUMMARY OF THE INVENTION

One object of the invention is to overcome the above-described drawbacks of the prior art.

Another object of the invention is to provide a technique for coding an audio signal that is different from, and more effective than, the known techniques. Another object of the invention, in at least one of its embodiments, is to provide such a technique, which makes it possible to define several strategies for formatting the bit stream.

These and other objects are attained in accordance with one aspect of the present invention directed to a method of hierarchically coding a source audio signal in the form of a data stream comprising a base level and at least two hierarchical enhancement levels, each of said levels being organized in successive frames. At least one frame of at least one enhancement level has a duration less than the duration of at least one frame of said base level. The method comprises a step for inserting into said stream at least one indication representative of an order used for a set of frames corresponding to the duration of at least one frame of said base level.

An aspect of the invention involves hierarchically coding the sinusoidal components of an audio signal in the form of basic frames, at least some of which have a duration greater than at least some of the enhancement frames coding the complementary components of the signal.

Thus, the inventive coding technique makes it possible to obtain a high compression ratio, and particularly for the base level, which makes it possible to transmit the coded signal with a reduced bit rate compared to the conventional coding techniques.

The indication representative of an order used is intended for the decoder to enable it to adopt the technique for demultiplexing the bit stream that is suited to the adopted multiplexing.

Moreover, this coding technique gives smaller grains of the coded bit stream resulting from the coding of the audio signal.

Advantageously, the duration of a base level frame is a multiple of the duration of a frame of at least one of said enhancement levels.

Thus, the frames of the base level can all have the same duration or different durations. Similarly, the frames of one and the same enhancement level can all have the same duration or different durations. Then, the frames of different enhancement levels can all have the same duration or different durations.

Preferably, said coding method comprises:

- a step for sinusoidally breaking down said source audio signal, delivering sinusoidal components forming said base level;
- a step for coding a residual signal, delivering complementary components forming at least one enhancement level.

For example, the residual signal can be obtained from the difference between the source audio signal and a signal reconstructed using the sinusoidal components.

According to one advantageous characteristic of the invention, said step for coding a residual signal uses a bank of analysis filters.

Thus, the bank of analysis filters provides a quantified version of each of the frames of the enhancement levels.

Advantageously, the coding method comprises, for the coding of at least one of said enhancement levels, at least one of the following steps:

- coding of a high-frequency envelope of the spectrum of said source audio signal;
- coding of at least one noise energy level over at least a part of the spectrum of said source audio signal;
- coding of data for reconstructing at least one complementary channel of said source audio signal from a mono signal;
- transmission of parameters associated with a step for duplicating the spectrum of said source audio signal.

The high-frequency envelope of the spectrum of the source audio signal and the noise energy levels over at least a part of the spectrum of this signal represent bandwidth extension information that can be used to enhance the spectrum of the decoded signal, particularly when the high frequencies are missing.

According to a first advantageous embodiment, the inventive method comprises a step for construction of the stream, sequencing the frames in a so-called horizontal order, according to which a frame of said base level then, for each of said enhancement levels in succession, all of the frames of said enhancement level covering the duration of said frame of the base level are taken into account.

According to a second advantageous embodiment, the inventive method comprises a step for construction of said stream, sequencing said frames in a so-called vertical order, according to which a frame of said base level then the first frame of each of said enhancement levels, then the subsequent frames, starting from a lower level to an upper level working in a chronological order, for all the frames of all the enhancement levels covering the duration of said frame of the base level are taken into account.

Thus, this second embodiment of the sequencing of the frames makes it possible to transmit access units of short duration and so offers the possibility of emptying the memory more rapidly.

According to a third advantageous embodiment, the inventive method comprises a step for construction of said stream, sequencing said frames in a so-called combined order, according to which a frame of said base level then, for the frames of all the enhancement levels covering the duration of said frame of the base level, a predetermined selection order are taken into account.

For example, this third embodiment of the sequencing of the frames can consist in taking into account the base level then several frames of an enhancement level covering the duration of the lower-level enhancement frame (in this case, optionally, the enhancement frames are coded in the stream by coding all the enhancement frames that are associated at the first instant before coding the frames that are associated in the next instant until the duration of the lower-level enhancement frame is covered) then the second frame of the first enhancement level and all the frames of all the enhancement levels associated with this second enhancement frame and so on until all the enhancement levels covering the duration of the base level are taken into account.

Advantageously, the step for construction of a stream implements at least two types of sequencing, according to at least two of the orders belonging to the group comprising the horizontal, vertical and combined orders, according to at least one predetermined selection criterion.

According to a preferred characteristic of the invention, said predetermined selection criterion is obtained according to at least one of the techniques belonging to the group comprising:

- an analysis of said source audio signal;
- an analysis of the processing and/or storage capacities of a receiver;
- an analysis of an available transmission bit rate;
- a selection instruction sent by a terminal;
- an analysis of the capacities of a network transmitting said stream.

Another aspect of the invention relates to a computer program product that can be downloaded from a communication network and/or stored on a medium that can be read by computer and/or executed by a microprocessor, comprising program code instructions for the implementation of the coding method as described previously.

Another aspect of the invention relates to a device for hierarchically coding a source audio signal in the form of a data stream comprising a base level and at least two hierarchical enhancement levels, each of said levels being organized in successive frames.

According to another aspect of the invention, the coding device comprises means of coding said frames, delivering at least one frame of at least one enhancement level which has a duration less than the duration of a frame of said base level, and according to which at least one indication representative of an order used for a set of frames corresponding to the duration of at least one frame of said base level is inserted into said stream.

Such a device can in particular implement the coding method as described previously.

Thus, according to an advantageous characteristic of the invention, the coding device comprises in particular:

- means of sinusoidally breaking down said source audio signal, delivering sinusoidal components forming said base level; and
- means of coding a residual signal, delivering complementary components forming at least one enhancement level.

Another aspect of the invention relates to a data signal representative of a source audio signal and taking the form of a data stream comprising a base level and at least two hierarchical enhancement levels, each of said levels being organized in successive frames.

According to an aspect of the invention, at least one frame of at least one enhancement level has a duration less than the duration of a frame of said base level, and said stream carries at least one indication representative of an order used for the sequencing of said frames, for a set of frames corresponding to the duration of at least one frame of said base level.

Such a data signal can in particular represent a data stream coded according to the coding method described hereinabove. The signal can obviously comprise the various characteristics relating to the inventive coding method described previously.

Thus, such a data signal can be obtained by means in particular:

- of means of sinusoidally breaking down said source audio signal, delivering sinusoidal components forming said base level; and
- means of coding a residual signal, delivering complementary components forming at least one enhancement level.

Another aspect of the invention relates to a method of decoding a data signal representative of a source audio signal and taking the form of a stream of data comprising a base level and at least two hierarchical enhancement levels, each of said levels being organized in successive frames, at least one frame of at least one enhancement level having a duration less than the duration of a frame of said base level, said stream carrying at least one indication representative of an order used for sequencing said frames, for a set of frames corresponding to the duration of at least one frame of said base level.

According to an aspect of the invention, the decoding method comprises a step for reconstruction of said source audio signal, taking into account, for a frame of said base level, at least two frames of at least one of said higher levels each being extended over a portion of the duration of said frame of the base level. The method also comprises a step for reading the indication representative of an order used for the sequencing of said frames, for a set of frames corresponding to the duration of at least one frame of said base level, and a step for processing said frames in said order.

Thus, the terminal adapts its demultiplexing to the multiplexing implemented in the coding.

Such a decoding method is suitable in particular for decoding a data stream coded according to the coding method described previously.

Thus, such a decoding method can comprise the following steps:

- reception of a coded signal as described hereinabove, and extraction on the one hand of a base level consisting of sinusoidal components and on the other hand of a residual signal, consisting of complementary components forming at least one enhancement level;
- reconstruction of a basic signal, from said sinusoidal components forming said base level;
- reconstruction of an improved signal, from said basic signal and said complementary components forming at least one enhancement level.

More generally, the decoding method implements steps for reconstruction of a signal corresponding to the source audio signal that are the reverse of the steps implemented in the coding method.

Another aspect of the invention relates to a computer program product that can be downloaded from a communication network and/or stored on a medium that can be read by computer and/or executed by a microprocessor, comprising program code instructions for the implementation of the decoding method described previously.

Another aspect of the invention relates to a device for decoding a data signal representative of a source audio signal and taking the form of a data stream comprising a base level and at least two hierarchical enhancement levels, each of said levels being organized in successive frames, at least one frame of at least one enhancement level having a duration less than the duration of a frame of said base level, said stream carrying at least one indication representative of an order used for the sequencing of said frames, for a set of frames corresponding to the duration of at least one frame of said base level.

According to an aspect of the invention, the decoding device comprises means of reconstructing said source audio signal, by taking into account, for a frame of said base level, at least two frames of at least one of said enhancement levels, each being extended over a portion of the duration of said frame of the base level. The device also comprises means of reading the indication representative of an order used for the sequencing of said frames, for a set of frames corresponding to the duration of at least one frame of said base level, and means of processing said frames in said order.

Such a decoding device can in particular implement the decoding method as described previously. It is consequently suitable for receiving a data stream coded by the coding device described previously.

BRIEF DESCRIPTION OF THE DRAWINGS

Other characteristics and advantages of the invention will become more clearly apparent from reading the following description of a preferred embodiment, given as an illustrative and nonlimiting example, and the appended drawings, in which.

DETAILED DESCRIPTION OF THE DRAWINGS

There follows a description of the methods of hierarchically coding and decoding digital audio signals implemented by hierarchical coding and decoding devices according to a preferred embodiment of the invention. These methods combine sinusoidal analysis/synthesis techniques, subband coding techniques and spectrum enrichment and stereophonic techniques.

6.1 Coding

Hereinafter, the hierarchical coding method (implemented by the hierarchical coding device) according to the invention is initially described, allowing for the coding of an initial digital audio signal in the form of a coded hierarchical bit stream (or coded digital audio signal) in the form of different layers (or levels).

The coding method described hereinafter comprises an analysis process which is used to estimate and code the sinusoidal components of a signal, code a residual signal in subbands (or layers or levels), code information linked to the band extension techniques and code conversion information of a monophonic signal into a signal with several channels, for example "Parametric Stereo" as defined in the reference document relating to the abovementioned "MPEG-4 audio" standard.

According to one embodiment of the invention, the base level is derived from a sinusoidal coder, the enhancement levels are derived from a band extension coder (example: SBR), a sinusoidal coder, a parametric stereo enrichment, a coding by residue transformed after subtraction of the sinusoids of the signal.

Figure 1:
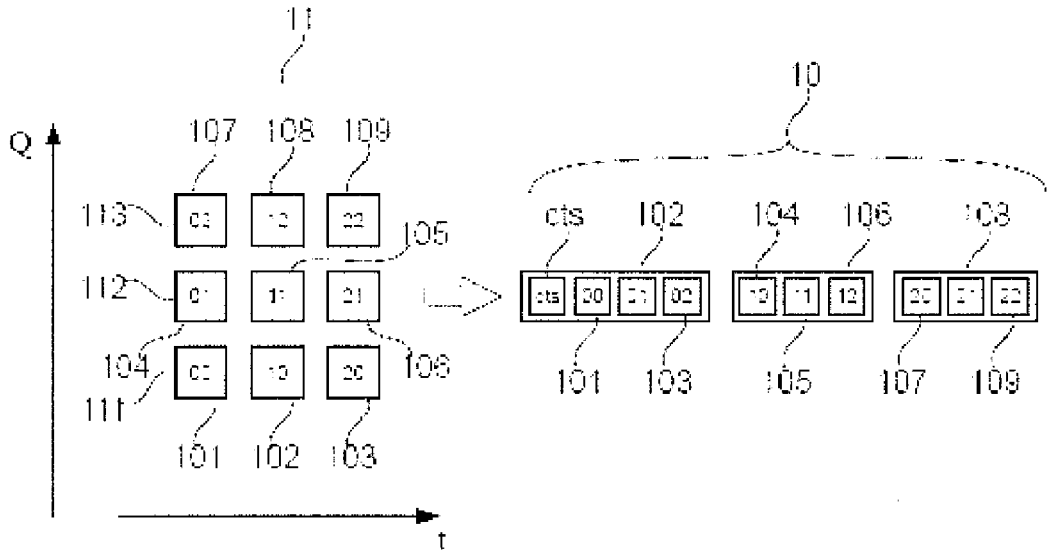
FIG. 1 is a diagram of a bit stream formatted by a conventional hierarchical coding.
Figure 2:
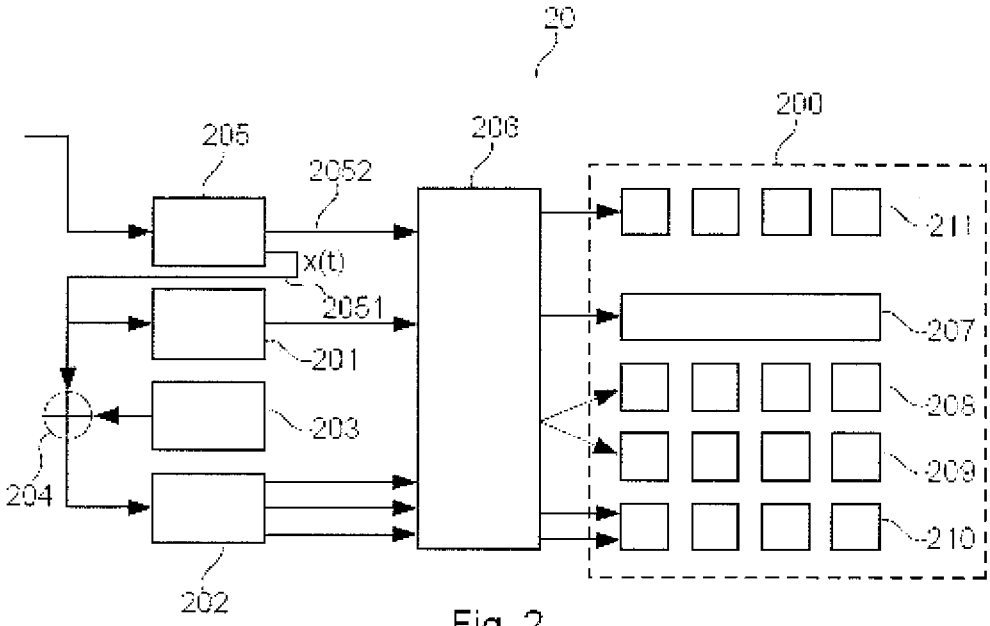
FIG. 2 is a diagram of the processing unit of a coding device according to a preferred embodiment of the invention.

A diagram of the processing unit 20 of a coding device (as illustrated hereinafter in relation to FIG. 7A) according to a preferred embodiment of the invention is presented in relation to FIG. 2.

The initial multi-channel audio signal (comprising m channels) is injected into a module for obtaining the mono signal 205 which delivers on the one hand a mono (short for monophonic) audio signal x(t) 2051 (or more generally n audio channels) and on the other hand reconstruction data 2052 for reconstructing one or more (m greater than n) channels, representative of the initial audio signal.

The reconstruction data 2052 is then transmitted to the formatting module 206 described hereinbelow.

The mono audio signal x(t) 2051 is for its part injected into a sinusoidal analysis module 201, the purpose of which is to extract sinusoidal components from the mono signal. It will be recalled that the sinusoidal modeling is based on the principle of breaking down a signal into a sum of sinusoids of frequency, amplitude and phase that are variable in time.

Thus, the audio signal x(t) can be expressed in the following form:

$$x(t) = \sum_{i=1}^{M} (A_i(t)\cos(\phi_i(t))) + r(t) \tag{1}$$

where:

r(t) represents the residual signal

M corresponds to the number of partials retained for the analysis $A_i(t)$ and $\phi_i(t)$ respectively represent the amplitude and the phase of the partial (or sinusoidal component of the audio signal x(t)) of index i.

The phase $\phi_i(t)$ of the partial of index i depends on the frequency $f_i$ of the partial and on its initial phase $\phi_{0i}(t)$ according to the following expression:

$$\phi_i(t) = \phi_{0_i} + 2\pi \int_0^t f_i(\tau)\, d\tau \tag{2}$$

A partial of several seconds can advantageously be modeled by a small set of parameters and for particular signals, this so-called "long-term" sinusoidal modeling becomes more effective (in terms of bit rate) than the so-called "short-term" modeling in subbands (or layers or levels) which subdivides the signal into frames of fixed length of a few tens of milliseconds.

The partials of the audio signal x(t) are transmitted by the sinusoidal analysis module 201 to a formatting module 206 described hereinbelow.

A sinusoidal synthesis module 203 makes it possible, using a subtraction device 204, to subtract from the audio signal x(t) the sinusoidal components of the audio signal x(t) in order to obtain the residual signal r(t).

The residual signal r(t) is then injected into a subband analysis module 202 described hereinbelow in relation to FIG. 3.

Figure 3:
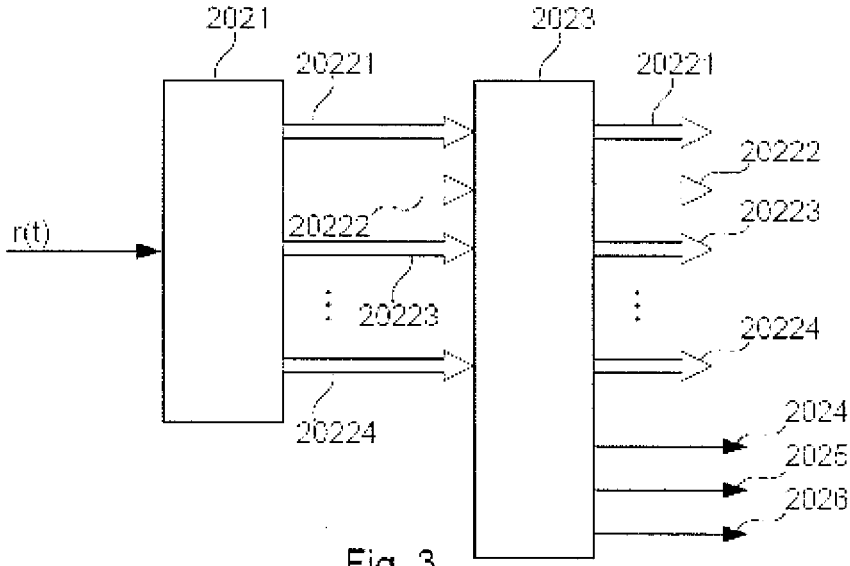
FIG. 3 is a diagram of a subband analysis module according to the preferred embodiment of the invention.

A diagram of the subband analysis module 202 according to the preferred embodiment of the invention is described in relation to FIG. 3. This module 202 comprises a bank of analysis filters (ABF) 2021.

In the context of this preferred embodiment of the invention, the bank of the analysis filters 2021 supplies a quantized component of each of the subbands (subband 0 referenced 20221, subband 1 referenced 20222, subband 2 referenced 20223, . . . subband N−1 referenced 20224 where N is an integer) of the residual signal r(t) which are then injected into an analysis and coding module 2023.

The analysis and coding module 2023 delivers to the formatting module 206 described hereinbelow, in addition to the quantized components of each of the subbands of the residual signal r(t), band extension information (high-frequency envelope 2024 and noise levels 2025), and reconstruction information for the various channels of the initial audio signal (which is, for example, a stereo or 5.1 audio signal) from the monophonic signal (stereo parameters 2026).

The formatting module 206 then constructs a hierarchical (or coded) bit stream 200 comprising frames of the following different layers (or levels):

- a so-called "long-term" base layer 207 (also called base level) describing the sinusoidal components (or partials) of the audio signal x(t) to be transmitted. This layer 207 typically models the long units of the signal x(t) corresponding to the partials. Each partial is described by a start time, its duration, and the amplitude, frequency and phase parameters that are variable in time. According to this preferred embodiment of the invention, the size of these "long-term" layers describing the sinusoidal components of the signal is less than 3 kbit/s. Optionally, a high-frequency envelope indication is also transmitted in this base layer in order to adjust the amplitudes of the sinusoids reconstructed on implementation of the inventive decoding method (described hereinbelow) by the sinusoidal extension module described hereinbelow.
- different so-called "short-term" enhancement layers 208 (also called enhancement levels) modeling the residual signal in subbands with varied degrees of precision (for example, FIG. 2 shows the hierarchical bit stream 200 with two enhancement levels 208, but any other number of enhancement levels can be envisaged in the context of the present invention). According to this preferred embodiment of the invention, the size of each of the enhancement layers 208 is between 4 and 16 kbit/s;
- a so-called "short-term" band extension layer 209 modeling the high-frequency envelope of the audio signal spectrum x(t) to be coded, and the noise energy levels in subbands over all or part of the spectrum of the signal x(t). The high-frequency envelopes for the sinusoids can be transmitted in this field. According to this particular embodiment of the invention, the size of this layer 209 is of the order of a few kbit/s;
- a so-called "short-term" layer 210 used to reconstruct the various channels of the audio (stereo or even 5.1) signal from the mono signal (parameters based, for example, on inter-oral time and level differences). According to this particular embodiment of the invention, the size of this layer is of the order of a few kbit/s.

The hierarchical bit stream 200 can also comprise an ancillary indication indicating to the inventive decoding device implementing the inventive decoding method (described hereinbelow) the reading mode for the hierarchical bit stream 200.

Advantageously, each of the layers (or levels) of the hierarchical bit stream 200 can also be broken down into different enrichment or enhancement levels in the form of improvement (or enhancement) frames:

- the sinusoids can be organized in frequency bands, each frequency band being transmitted in different units (or frames);
- the residual signal can be subdivided into different bands and precision enrichment each of these entities being able to be associated with as many additional enrichment frames;
- the high frequency indications for the spectral enrichment can themselves be organized in different enrichment bands, for example 3.4 kHz-7 kHz then 7 kHz-15 kHz in order to progressively obtain a hi-fi band.

the stereo information can also be organized in several layers: at the outset, a parametric layer is transmitted then progressively it is the difference signal of the left and right channels that is transmitted in order to faithfully recreate the stereo.

Advantageously, as illustrated by FIG. 2, in the context of this preferred embodiment of the invention, the frames of the base layer 207 (or base level) corresponding to the sinusoidal indications describe the portions of the signal that are longer than the frames of the enhancement layers (or levels) 208, the frames of the enhancement layers being of the same length. Obviously, in variants of this embodiment, the frames of the enhancement levels can have different lengths according to their position in one and the same enhancement level or according to the enhancement levels to which they belong.

The transmission or storage of these indications is handled according to the following options (illustrated by means of FIGS. 6A to 6D described in more detail hereinbelow):

a first so-called "vertical" mode reading option (illustrated hereinbelow by FIGS. 6A and 6C) which consists in transmitting the base level then, successively, the first frames of all the enhancement levels, then the other frames of the higher enhancement levels starting from the lower levels and working towards the higher levels in chronological order;

a second so-called "horizontal" mode reading option (illustrated hereinbelow by FIGS. 6A and 6B) which consists in transmitting the base level followed by all the frames of the first enhancement level covering the duration of the base level, followed by all the frames of the second enhancement level covering the duration of the base level and so on until all the enhancement levels covering the duration of the base level have been transmitted;

a third so-called "combined" mode reading option (illustrated hereinbelow by FIGS. 6A and 6D) which consists in transmitting the base level then several frames of an enhancement level covering the time duration of the lower-level enhancement frame (in this case, optionally, the enhancement frames are coded in the stream by coding all the enhancement frames associated with the first instant before coding the frames associated with the next instant until the duration of the lower-level enhancement frame is covered) then the second frame of the first enhancement level and all the frames of all the enhancement levels associated with this second enhancement frame and so on until all the enhancement levels covering the duration of the base level have been transmitted.

The order of transmission of the enhancement frames is indicated by the coder in the stream in the form of an initialization indication for the decoder.

6.2 Decoding

Secondly, the hierarchical decoding method (implemented by the hierarchical decoding device) is described. This method, from the coded (or hierarchical) bit stream 200 received, can be used to reconstruct a synthesized digital audio signal that best approaches the previously coded initial digital audio signal.

The hierarchical bit stream 200 obtained by means of the hierarchical coding method described previously (implemented by the processing unit 20 of the coding device described in relation to FIG. 2) is transmitted via a transmission channel then received by the decoding device implementing the inventive hierarchical decoding method described hereinbelow.

Figure 4:
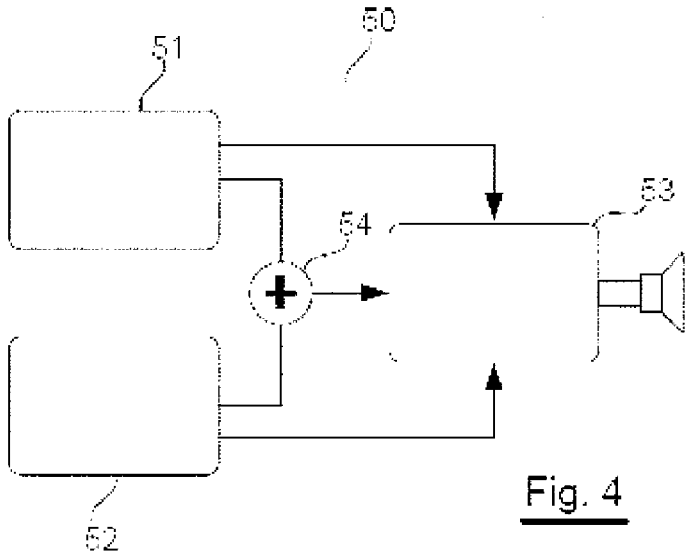
FIG. 4 is a simplified diagram of the processing unit of a decoding device according to the preferred embodiment of the invention.

A simplified diagram of the processing unit 50 of a decoding device (as illustrated hereinbelow in relation to FIG. 7B) according to a preferred embodiment of the invention is presented in relation to FIG. 4.

On receiving the hierarchical bit stream 200, the processing unit 50 is then responsible for demultiplexing the various layers of the hierarchical bit stream and decoding the useful information for the sinusoidal synthesis module 51, for the module decoding the residual signal into subbands 52 and for the band extension modules 53 and for the stereo.

The information extracted from the base layer (sinusoidal elements) are injected into the sinusoidal synthesis module 51 which, from the received information (frequencies, phases and amplitudes of each of the partials or of a set of partials), synthesizes the signal corresponding to the sum of the transmitted partials.

The information extracted from the enhancement layers (or levels) 208 modeling the residual signal (also called residual elements) is injected into the module decoding the residual signal in subbands 52.

The signals output from the sinusoidal synthesis module 51 and the module decoding the residual signal in subbands 52 are added together by an adding device 54, then the sum is applied as input for the band extension module 53.

The information from the band extension layer 209 modeling the high-frequency envelope and the noise energy levels in subbands (called band extension elements) are injected into the band extension module 53 (also called spectrum enrichment module) which uses the signals reconstructed by the previous two modules to synthesize the output signal.

For reasons of legibility of the diagrams, the module converting the mono signal into stereo (or 5.1) signal is not represented in this FIG. 4.

Figure 5:
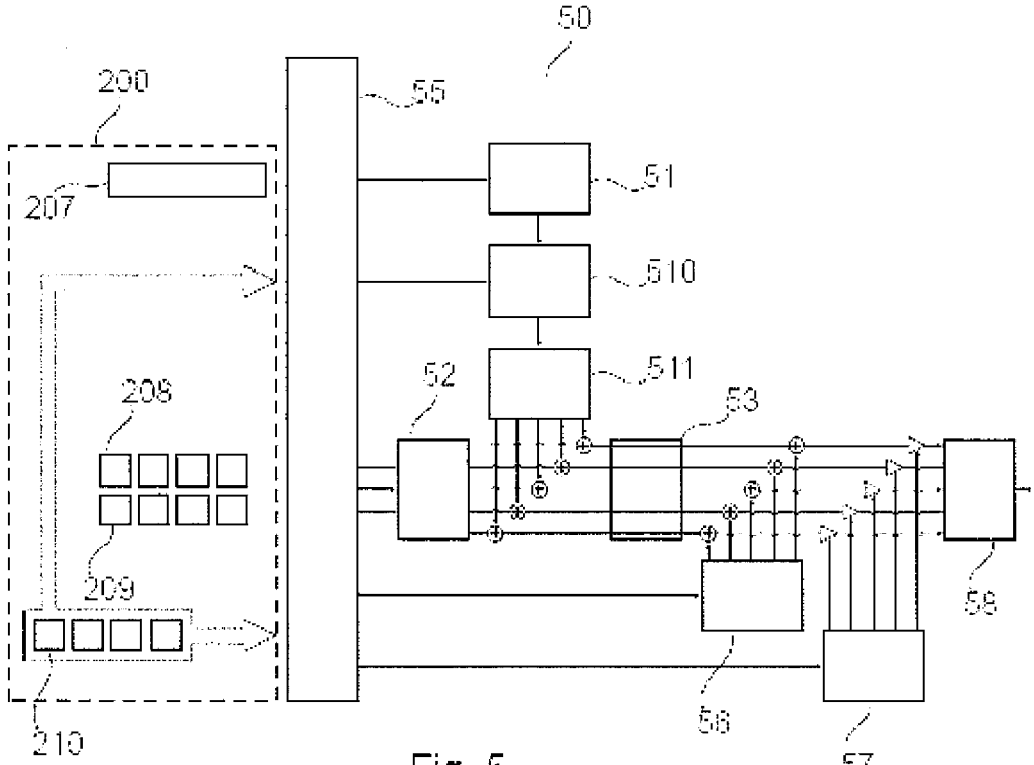
FIG. 5 is a complete diagram of the processing unit of the decoding device of FIG. 4.

A complete diagram of the processing unit 50 of the decoding device according to the preferred embodiment of the invention is presented in relation to FIG. 5.

The steps of the method of decoding and formatting the bit stream according to the preferred embodiment of the invention are described hereinbelow, in relation to the processing unit 50 of the decoding device of this FIG. 5.

On receiving the hierarchical bit stream 200 (for example, with three enhancement levels 208), a demultiplexing module 55 is responsible for demultiplexing the various layers (or levels) of the hierarchical bit stream 200.

The information contained in the base level 207 is used by the sinusoidal synthesis module 51 to synthesize the various partials contained in the previously coded initial audio signal x(t).

In a preferred embodiment of this preferred implementation, the duly synthesized partials are then injected into a sinusoidal extension module 510, the purpose of which is to use the transmitted partials to synthesize partials at multiples of the frequency of each of these transmitted partials. This operation in fact corresponds to an interpolation of a truncated harmonic series, in accordance with the following equations (3) and (4).

From a transmitted partial satisfying the following equation:

$$p_0(t) = \cos\left(\phi_0 + 2\pi \int_0^t f_i(\tau)\, d\tau\right) \tag{3}$$

the harmonic series satisfying the following equation is synthesized:

$$P(t) = \sum_{n=1}^{N-1} \cos\left(\phi_n + 2\pi \int_0^t n f_i(\tau)\, d\tau\right) \quad (4)$$

where $\phi_n$ is either equal to $\phi_0$ or equal to a random number.

With the phases and the frequencies of the synthesized partials thus being directly calculated by the sinusoidal synthesis module 51, their amplitudes remain to be adjusted. The envelope information transmitted in the hierarchical bit stream 200 in the band extension level 209 (modeling the high-frequency envelope and the noise energy levels in subbands) can be used to adjust the amplitude of the sinusoids of the duly synthesized partials.

Thus, in the context of the present preferred implementation of the invention, this high-frequency envelope information is transmitted in the band extension layer 209 (which is a "short-term" layer). However, in a variant of this preferred implementation that is not illustrated, this envelope information is transmitted in the "long-term" base layer 207 describing the sinusoidal part of the signal.

In the context of the preferred embodiment, the signal output from the sinusoidal extension module 510 is then injected into a subband analysis module 511.

The information contained in the various enhancement layers 208 describing the residual signal r(t) in subbands is injected into the residual decoding module 52.

It is assumed, in the context of the present preferred implementation, that the capacity of the transmission channel is sufficient to transmit all the enhancement layers 208 describing the residual signal r(t) (favorable case).

In variants of this preferred implementation, for example when the bandwidth is limited, the enhancement layers 208 cannot all be received by the processing unit 50 (averagely favorable case), and sometimes even none of the enhancement layers is received (unfavorable case).

The subbands deriving from the residual decoding module 52 and subband analysis module 511 are then added together before being injected into the band extension module 53.

In the abovementioned averagely favorable case, the information recovered from the hierarchical bit stream 200 cannot be used to synthesize the audio signal x(t) in full band mode, so the high frequency subbands are then missing. The role of the band extension module 53 is in this case to synthesize the high frequency subbands from the low frequency subbands in accordance with the technique described in the document by Martin Dietz, Lars Liljeryd, Kristofer Kjörling and Oliver Kunz entitled "Spectral Band Replication—A Novel Approach in Audio Coding", 112nd AES convention, Munich 2002.

At the output of the band extension module 53, noise is added to each of the subbands using the noise generation module 56. The noise energy levels to be injected into each of the subbands are received in the hierarchical bit stream 200, in the band extension layer 209.

The energies of the resulting subbands are then adjusted by an envelope adjustment module 57. The energy levels of each of the subbands are also received in the hierarchical bit stream 200, in the band extension layer 209.

The resultant subbands are then injected into a bank of synthesis filters called subband synthesis module 58.

The signal output from this subband synthesis module 58 is then added to the sinusoidal part deriving from the sinusoidal synthesis module 51 and, optionally, from the sinusoidal extension module 510 (the means implementing the latter step are not represented in FIG. 5).

A synthesized digital audio signal is thus obtained which best approaches the initial audio signal x(t).

According to the information received by the decoding device via the hierarchical bit stream 200, the synthesized digital audio signal can thus correspond in particular to:

- either the sum of the transmitted sinusoids and, where appropriate, of the sinusoids interpolated and adjusted by the sinusoidal extension module 510, and of the noise if none of the enhancement layers 208 (describing the residual signal in subbands) are received by the decoding device;
- or the sum of the sinusoids, of the transmitted low frequency subbands and of the signals duplicated at high frequencies by the band extension module 53;
- or the sum of the transmitted sinusoids, of the sinusoids interpolated and adjusted by the sinusoidal extension module 510, of the transmitted low frequency subbands, of the low frequency subbands duplicated at high frequencies by the band extension module 53, and the noise formatted across the entire band, and the reconstruction of the m channels (for example 2 for a stereo system) from the n transmitted channels (for example 1 mono channel).

Two examples of demultiplexing or reading a hierarchical bit stream according to the invention are described hereinbelow.

Figure 6A:
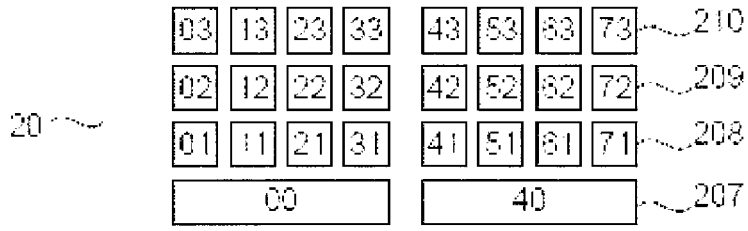
FIGS. 6A to 6D illustrate the first (FIG. 6B), second (FIG. 6C) and third (FIG. 6D) examples, conforming to the invention, of reading a hierarchical bit stream presented in FIG. 6A.
Figure 6B:
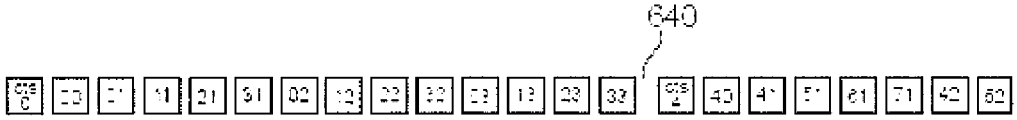

A first example, according to the invention, of reading (FIG. 6B) the hierarchical bit stream 200 obtained from the structure of FIG. 6A is presented in relation to FIGS. 6A and 6B. This first example of reading, called "horizontal", is more costly in terms of memory resource, but optimum from the point of view of quality if all the levels are not received.

The hierarchical bit stream 200 comprises a base level 207, and first, second and third enhancement levels 208 to 210. A frame 00 or 40 of the base level 207 is followed by:

- 4 frames 01, 11, 21, 31 or 41, 51, 61, 71 of the first enhancement level 208; then by
- 4 frames 02, 12, 22, 32 or 42, 52, 62, 72 of the second enhancement level 209; then by
- 4 frames 03, 13, 23, 33 or 43, 53, 63, 73 of the third enhancement level 210.

This first reading example (FIG. 6B) therefore consists in reading the base level followed by all the frames of the first enhancement level covering the duration of the base level, followed by all the frames of the second enhancement level covering the duration of the base level, and so on until all the enhancement levels covering the duration of the base level have been transmitted.

Thus, a frame corresponding to an enhancement level n is read after the enhancement level n−1 is completely read for the duration of the base level.

The demultiplexed hierarchical bit stream 640 is thus obtained.

cts ("composition time stamp") fields, which delimit system level layers and make it possible to indicate to the decoding device the moment of composition of the transmitted units, are incorporated in the bit stream 640.

Figure 6C:
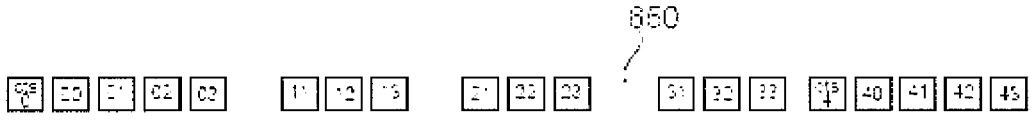
Figure 6D:
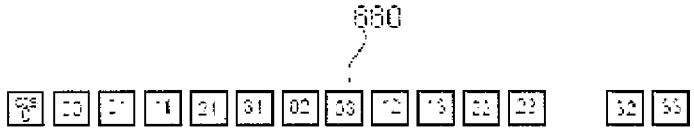

A second example according to the invention of reading (FIG. 6C) the hierarchical bit stream 200 of FIG. 6A is described in relation to FIGS. 6A and 6C. This second example, called "vertical", offers the possibility of transmitting access units of short duration and so offers the possibility of implementing a decoding with small delay.

This second example of reading (FIG. 6C) consists in reading the first frame of the base level then the first frames of the first, second and third enhancement levels, then the second frames of the first, second and third enhancement levels and so on so as to cover the duration of the base level. Then, the second frame of the base level is read, and so on.

The second demultiplexed hierarchical bit stream 650 is thus obtained.

Of course, other inventive methods of reading hierarchically organized bit streams can be obtained by combining the so-called "vertical" and "horizontal" reading examples.

The order in which the various layers of the hierarchical bit stream are organized must be known to the decoder. For this, the information (for example, initialization information generated by the coding device) is transmitted in a special syntax field which is transmitted in the hierarchical bit stream.

A table illustrating a syntax for reading the information concerning the demultiplexing or reading mode (for example the first and second abovementioned reading examples) that the decoding device must adopt is given in appendix 1.

In the context of the present preferred implementation of the invention, this reading mode is indicated in a two-bit field called "framingMode".

- if the framingMode field takes the value 0x00, then the decoding device adopts the first reading example, called "horizontal" as described previously in relation to FIG. 6B (this reading mode is implicit);
- if the framingMode field takes the value 0x01, then the decoding device adopts the second reading example, called "vertical" as previously described in relation to FIG. 6C (this reading mode is implicit);
- if the framingMode field takes the value 0x10, then the decoder analyzes an additional field (called "advanced-FramingInformation") which specifies the reading mode. This additional field allowing for specific framing modes is described hereinbelow.
- if the framingMode field takes the value 0x11, then a reserved mode applies.

A table illustrating a syntax for reading the framing in the case of a non-implicit framing mode is given in appendix 2.

The number of enhancement levels is read first. Then, for each of the levels (apart from the last), the order of reading the next level is indicated: by enhancement layer (layerOrganization[layer]=0) or by time instant until the duration of the preceding enhancement level is completely covered (layerOrganization[layer]=1).

The duration of each enhancement level is known to the decoder from configuration information specific to the various fields (sinusConfig( ), transformConfig( ), BandwidthExtensionConfig( ), StereoExtension( )).

The inventive coding method can be implemented in numerous devices, such as stream servers, intermediate nodes of a network, senders, data storage devices, etc.

Figure 7A:
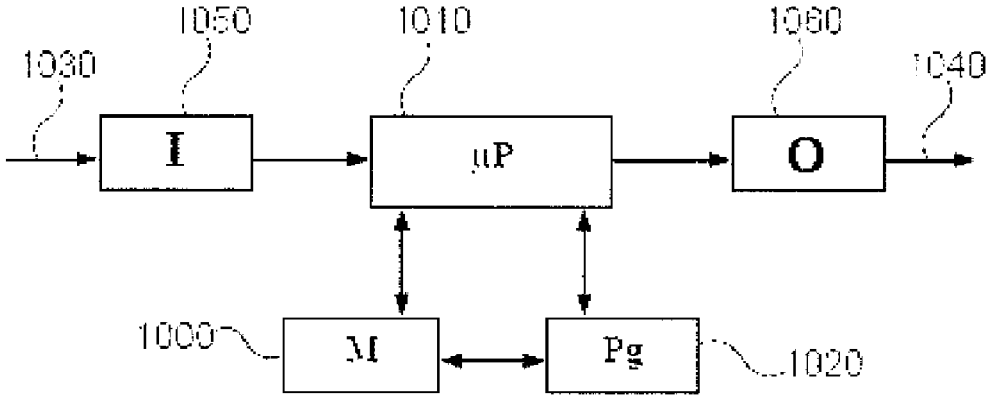
FIGS. 7A and 7B are diagrams of the simplified general structure of the coding device (FIG. 7A) and decoding device (FIG. 7B) according to the invention.

The simplified general structure of such a coding device is illustrated diagrammatically by FIG. 7A. It comprises a memory M 1000, a processing unit 1010 (such as the processing unit 20 described in relation to FIG. 2), equipped, for example, with a microprocessor, and driven by the computer program Pg 1020.

On initialization, the code instructions of the computer program 1020 are, for example, loaded into a RAM memory before being executed by the processor of the processing unit 1010. The processing unit 1010 receives at the input 1050 an audio signal 1030. The microprocessor μP of the processing unit 1010 implements the method described hereinabove, according to the instructions of the program Pg 1020. The processing unit 1010 delivers at the output 1060 a hierarchical bit stream 1040 (corresponding to the coded audio signal).

The inventive decoding method can be implemented in numerous devices, such as stream servers, intermediate nodes of a network, senders, data storage devices, etc.

Figure 7B:
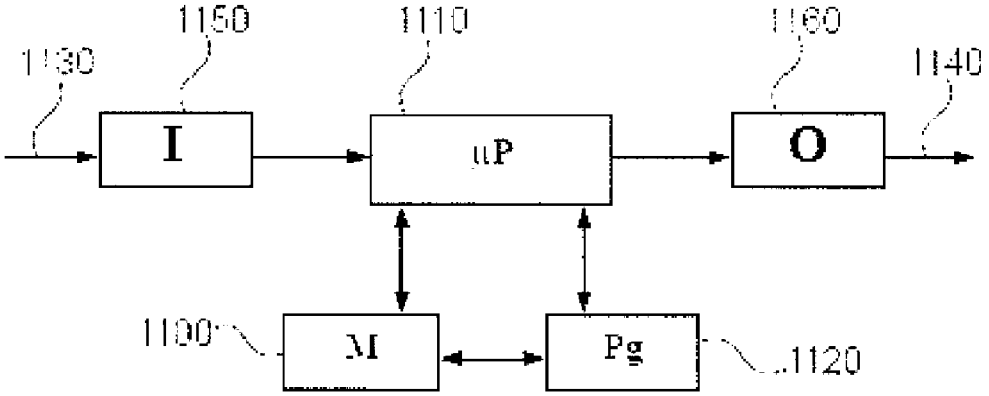

The simplified general structure of such a decoding device is diagrammatically illustrated by FIG. 7B. It comprises a memory M 1100, a processing unit 1110 (such as the processing unit 50 described in relation to FIG. 5), equipped, for example, with a microprocessor, and driven by the computer program Pg 1120.

On initialization, the code instructions of the computer program 1120 are, for example, loaded into a RAM memory before being executed by the processor of the processing unit 1110. The processing unit 1110 receives as input 1150 a hierarchical bit stream 1130. The microprocessor μP of the processing unit 1110 implements the method described hereinabove, according to the instructions of the program Pg 1120. The processing unit 1110 delivers as output 1160 a decoded audio signal 1140.

APPENDIX 1

| Syntax | | No. of bits | Mnemonic |
|---|---|---|---|
| decoderSpecificConfiguration( ) | | | |
| { | | | |
| FramingMode | | 2 | uimsbf |
| if ( framingMode == 0x10) | | | |
| advancedFramingInformation( ); | | | |
| sinusConfig( ) | // elements for initialization | | |
| transformConfig( ) | // elements for initialization | | |
| BandwidthExtensionConfig( ) | // elements for initialization | | |
| StereoExtension( ) | // elements for initialization | | |
| } | | | |

APPENDIX 2

| Syntax | No. of bits | Mnemonic |
|---|---|---|
| advancedFramingInformation( ) | | |
| { | | |
| nELayers | 4 | uimsbf |
| for(layer =0; layer <nELayers−1;layer++) | | |
| layerOrganization[layer] | 1 | uimsbf |
| } | | |

The invention claimed is:

1. A method of hierarchically coding a source audio signal in the form of a data stream comprising a base level and at least two hierarchical enhancement levels, each of said levels being organized in successive frames, wherein at least one frame of at least one enhancement level has a duration less than the duration of at least one frame of said base level, and wherein the method comprises a step of inserting into said stream at least one indication representative of an order used for a set of enhancement level frames corresponding to the duration of at least one frame of said base level.

2. The coding method as claimed in claim 1, wherein the duration of a base level frame is a multiple of the duration of a frame of at least one of said enhancement levels.

3. The coding method as claimed in claim 1, wherein said coding method comprises the steps of:

sinusoidally breaking down said source audio signal, delivering sinusoidal components forming said base level; and coding a residual signal, delivering complementary components forming at least one enhancement level.

4. The coding method as claimed in claim 3, wherein said step of coding a residual signal uses a bank of analysis filters.

5. The coding method as claimed in claim 1, comprising, for the coding of at least one of said enhancement levels, at least one of the following steps:

coding of a high-frequency envelope of the spectrum of said source audio signal;

coding of at least one noise energy level over at least a part of the spectrum of said source audio signal;

coding of data for reconstructing at least one complementary channel of said source audio signal from a mono signal; and transmission of parameters associated with a step for duplicating the spectrum of said source audio signal.

6. The coding method as claimed in claim 1, comprising constructing said stream, sequencing said frames in a so-called horizontal order, according to which a frame of said base level then, for each of said enhancement levels in succession, all of the frames of said enhancement level covering the duration of said frame of the base level are taken into account.

7. The coding method as claimed in claim 1, comprising constructing said stream, sequencing said frames in a so-called vertical order, according to which a frame of said base level then the first frame of each of said enhancement levels, then the subsequent frames, starting from a lower level to an enhancement level working in a chronological order, for all the frames of all the enhancement levels covering the duration of said frame of the base level are taken into account.

8. The coding method as claimed in claim 1, comprising constructing said stream, sequencing said frames in a so-called combined order, according to which a frame of said base level then, for the frames of all the enhancement levels covering the duration of said frame of the base level, a predetermined selection order are taken into account.

9. The coding method as claimed in claim 6, wherein said step constructing a stream implements at least two types of sequencing, according to at least two of the orders belonging to the group comprising the horizontal, vertical and combined orders, according to at least one predetermined selection criterion.

10. The coding method as claimed in claim 9, wherein said predetermined selection criterion is obtained according to at least one of the techniques belonging to the group comprising:

an analysis of said source audio signal;

an analysis of the processing and/or storage capacities of a receiver;

an analysis of an available transmission bit rate;

a selection instruction sent by a terminal;

an analysis of the capacities of a network transmitting said stream.

11. A computer program stored on a non-transitory medium that can be read by computer and/or executed by a microprocessor, comprising program code instructions for implementing the method of claim 1.

12. A device for hierarchically coding a source audio signal in the form of a data stream comprising a base level and at least two hierarchical enhancement levels, each of said levels being organized in successive frames, wherein the device comprises means of coding said frames, according to which at least one frame of at least one enhancement level has a duration less than the duration of a frame of said base level, and according to which at least one indication representative of an order used for a set of enhancement level frames corresponding to the duration of at least one frame of said base level is inserted into said stream.

13. A method of decoding a data signal representative of a source audio signal and taking the form of a stream of data comprising a base level and at least two hierarchical enhancement levels, each of said levels being organized in successive frames, at least one frame of at least one enhancement level having a duration less than the duration of a frame of said base level, said stream carrying at least one indication representative of an order used for sequencing said frames, for a set of enhancement level frames corresponding to the duration of at least one frame of said base level, wherein the method comprises the steps of:

reconstructing said source audio signal, taking into account, for a frame of said base level, at least two frames of at least one of said enhancement levels each being extended over a portion of the duration of said frame of the base level; and reading the indication representative of an order used for the sequencing of said frames, for a set of enhancement level frames corresponding to the duration of at least one frame of said base level, and a step for processing said frames in said order.

14. A computer program stored on a non-transitory medium that can be read by computer and/or executed by a microprocessor, wherein the computer program comprises program code instructions for implementing the method of claim 13.

15. A device for decoding a data signal representative of a source audio signal and taking the form of a data stream comprising a base level and at least two hierarchical enhancement levels, each of said levels being organized in successive frames, at least one frame of at least one enhancement level having a duration less than the duration of a frame of said base level, said stream carrying at least one indication representative of an order used for the sequencing of said frames, for a set of enhancement level frames corresponding to the duration of at least one frame of said base level, wherein the device comprises:

means of reconstructing said source audio signal, by taking into account, for a frame of said base level, at least two frames of at least one of said enhancement levels, each being extended over a portion of the duration of said frame of the base level; and means of reading the indication representative of an order used for the sequencing of said frames, for a set of enhancement level frames corresponding to the duration of at least one frame of said base level, and means of processing said frames in said order.

* * * * *